US011634256B2

(12) United States Patent
Bull

(10) Patent No.: US 11,634,256 B2
(45) Date of Patent: Apr. 25, 2023

(54) FLOW CONTROL INSERT

(71) Applicant: Obrist Closures Switzerland GmbH, Reinach (CH)

(72) Inventor: Martin Carey Bull, Norfolk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 17/312,994

(22) PCT Filed: Nov. 12, 2019

(86) PCT No.: PCT/EP2019/081080
§ 371 (c)(1),
(2) Date: Jun. 11, 2021

(87) PCT Pub. No.: WO2020/120053
PCT Pub. Date: Jun. 18, 2020

(65) Prior Publication Data

US 2022/0073240 A1 Mar. 10, 2022

(30) Foreign Application Priority Data

Dec. 13, 2018 (GB) ..... 1820292

(51) Int. Cl.
*B65D 47/20* (2006.01)
*B65D 47/08* (2006.01)

(52) U.S. Cl.
CPC ..... *B65D 47/2031* (2013.01); *B65D 47/0809* (2013.01); *B65D 2547/066* (2013.01)

(58) Field of Classification Search
CPC .. B67D 47/2031–2043; B67D 47/0809; B65D 2547/066
See application file for complete search history.

(56) References Cited

U.S. PATENT DOCUMENTS 1,100,433 A * 6/1914 Johnson ..... 222/546
2,219,604 A * 10/1940 Trotter ..... B65D 35/40 215/11.1
3,067,787 A * 12/1962 Salk ..... B65D 55/02 222/490
3,179,301 A * 4/1965 Lucht ..... B65D 47/2031 215/11.1
3,273,754 A * 9/1966 Lindley ..... B65D 47/2031 222/541.6

(Continued)

FOREIGN PATENT DOCUMENTS

GB 899807 A 6/1962
WO 2007097744 A1 8/2007
WO 2015092452 A1 6/2015

OTHER PUBLICATIONS

Axial Definition & Meaning—Merriam-Webster; obtained on Feb. 17, 2022 from: https://www.merriam-webster.com/dictionary/axial.*

(Continued)

*Primary Examiner* — Paul R Durand
*Assistant Examiner* — Randall A Gruby
(74) *Attorney, Agent, or Firm* — Banner & Witcoff, Ltd.

(57) ABSTRACT

A flow control insert (102) for a dispensing closure is provided. The insert has a plurality of dispensing slits (that define petals. (120,122,124,126). The petals are formed in an open position and are closed upon assembly of the insert into a dispensing closure.

14 Claims, 16 Drawing Sheets

(56) References Cited

U.S. PATENT DOCUMENTS 3,480,182 A * 11/1969 Rigor ..... B65D 83/049 141/321
3,637,109 A * 1/1972 Stiffer ..... B65D 41/26 221/310
3,690,514 A * 9/1972 Wilson ..... B65D 47/148 222/546
4,133,457 A * 1/1979 Klassen ..... B65D 47/2031 137/849
4,749,108 A * 6/1988 Dornsbusch ..... B65D 23/00 222/545
5,115,950 A * 5/1992 Rohr ..... B65D 47/2031 222/212
5,271,531 A * 12/1993 Rohr ..... B65D 47/0833 222/212
5,743,443 A * 4/1998 Hins ..... B65D 47/2031 222/490
5,897,033 A * 4/1999 Okawa ..... B65D 47/2031 222/546
5,927,549 A * 7/1999 Wood ..... B65D 51/285 222/129
5,927,566 A * 7/1999 Mueller ..... B29C 49/02 D9/453
6,089,411 A * 7/2000 Baudin ..... B65D 47/2031 222/546
6,089,418 A * 7/2000 Gaiser ..... B65D 47/2031 222/490
6,152,324 A * 11/2000 Baudin ..... B29C 45/0046 264/318
6,672,487 B1 * 1/2004 Lohrman ..... B65D 47/0804 222/546
6,902,076 B2 * 6/2005 Bauer ..... B65D 51/20 215/253
6,910,607 B2 * 6/2005 Gaiser ..... B65D 47/2031 222/562
7,152,763 B2 * 12/2006 Stull ..... B29C 45/0081 222/546
7,255,250 B2 * 8/2007 Pugne ..... B65D 47/0804 222/546
7,306,128 B2 * 12/2007 Eimer ..... B65D 47/2031 222/490
7,842,215 B2 * 11/2010 Eimer ..... B65D 47/2031 264/339
8,118,183 B2 * 2/2012 Iwahashi ..... B65D 83/0055 215/385
8,220,670 B2 * 7/2012 Moribata ..... B65D 47/0814 222/546
8,640,928 B2 * 2/2014 Ellenkamp-Van Olst ..... F16K 15/147 222/545
8,733,600 B2 * 5/2014 Pritchard ..... B65D 75/5877 222/541.9
8,978,939 B2 * 3/2015 Bull ..... B65D 47/2031 222/490
9,914,570 B2 * 3/2018 Rideg ..... B29C 45/4005
10,689,167 B2 * 6/2020 Sakimura ..... B65D 47/2031
10,836,541 B2 * 11/2020 Proudfoot ..... F16K 15/147
2002/0148856 A1 * 10/2002 Morandell ..... B65D 47/243 222/107
2003/0042257 A1 * 3/2003 Uchiyama ..... B65D 47/36 215/253
2003/0189067 A1 * 10/2003 Stull ..... B65D 47/2031 222/494
2006/0201976 A1 * 9/2006 Bloom ..... B65D 47/2031 222/494
2007/0029352 A1 * 2/2007 Norris ..... B65D 47/0833 222/494
2008/0237271 A1 * 10/2008 Olechowski ..... B65D 47/2031 222/494
2009/0212078 A1 * 8/2009 Gaus ..... B65D 47/2031 222/490
2009/0242589 A1 * 10/2009 Berthelin ..... B65D 47/2031 220/288
2013/0256342 A1 * 10/2013 Bloom ..... B65D 47/2031 222/494
2014/0209644 A1 * 7/2014 Socier ..... B65D 47/2031 222/494
2016/0023818 A1 * 1/2016 Gelov ..... B65D 35/04 220/254.1
2022/0297895 A1 * 9/2022 Proudfoot ..... F16K 15/147

OTHER PUBLICATIONS

Mar. 12, 2020—(WO) International Search Report and Written Opinion—Appl. No. PCT/EP2019/081080, 14 pages.

* cited by examiner

FLOW CONTROL INSERT

CROSS-REFERENCE TO RELATED APPLICATIONS

This application is a U.S. National Stage application under 35 U.S.C. § 371 of International Application PCT/EP2019/081080 (published as WO 2020/120053), filed Nov. 12, 2019, which claims the benefit of priority to U.K. Application No. 1820292.9, filed Dec. 13, 2018. Each of these prior applications is hereby incorporated by reference in their entirety.

The present invention relates to a flow control insert for defining an orifice in a dispensing closure. The insert may be fitted into, and retained within, a dispensing closure.

A dispensing closure is one which is typically held in place on, and associated with, the mouth of a container. It has an orifice which is associated with the orifice in the container such that the contents of the container may only be dispensed via the orifice in the closure. Such dispensing closures typically also comprise a lid which may be hinged to the dispensing closure and which may be formed integrally therewith (known, for example, as a flip-top dispensing closure). The purpose of the lid is to seal the orifice in the closure so that, in the closed position, no product may be dispensed whether deliberately or accidentally.

The present invention may provide a flow control insert which is manufactured with a plurality of dispensing slits that define petals formed in an open position. The petals/slits are closed upon assembly into a dispensing closure.

In some embodiments the petals are substantially completely closed, for example so as to form a seal. In other embodiments the petals are partially closed; a full seal may then, for example, be provided when the closure is in a closed position (e.g. a lid may complete the seal when closed).

The present invention may provide an insert for a dispensing closure of the type having a housing with engagement means adapted to receive a flow control insert. The insert may have standardised insert engagement means adapted to engage the housing engagement means and thereby to be received/receivable directly into the closure housing in use.

The present invention may provide a single moulded component (moulded in e.g. PP, PE, TPE, TPS).

The insert may be configured to fit into the same closure retention features as per existing flow control inserts.

The insert may provide a cheaper (and possibly less functional) dispensing "baffle".

Some embodiments provide a TPE/TPS non-valve flow restrictor.

Some embodiments relate to a method of providing a flow control insert, for example including the steps of: 1—injection moulding the design with the slits open i.e. not slit after moulding; and 2—using a closure to offer a positive pressure against the open slits to close them upon assembly to the closure.

In some embodiments, therefore, the idea is to mould the valve slits open and then use the closure to close the petals.

The present invention may provide an insert which, when assembled to the closure housing, closes the open petals to form the seal. The design may be a single piece moulding with a central hole plugged by the lid spigot.

The insert may be produced with a standard outer size so that it fits standard engagement features on a dispensing closure.

For example the insert may be designed to fit into the same closure retention features as used by existing inserts, such as those described in WO2006/021509 or WO2008/001035.

In one embodiment, the insert engaging means may include a bead projecting radially outward from an exterior wall for snap-fitting the insert into the dispensing closure.

The bead for snap-fitting may be arranged so that it seals against the dispensing closure so that the product only passes through the orifice of the insert and not around the sides.

Alternatively and/or additionally, the insert could be glued, welded and/or retained in the closure by other means.

The insert may include an inner sealing bead projecting axially outward from an exterior wall for providing a seal between the insert and closure in use.

Alternatively and/or additionally, the insert may include means to locate the insert in a closure in use, wherein the means project axially outward from an exterior wall of the insert. The locating means may provide a seal against the closure, in use.

The insert may be produced from plastics, which in one embodiment are injection moulded.

In another aspect, the invention provides a combination of a dispensing closure and an insert comprising one or more of the features described herein.

The present invention also provides a flow control insert for a dispensing closure, the insert has a plurality of dispensing slits that define petals, the petals are formed in an open position, in which the petals are closed upon assembly into a dispensing closure.

The present invention also provides an insert for a dispensing closure of the type having a housing with engagement means adapted to receive a flow control insert, the insert has standardised insert engagement means adapted to engage the housing engagement means and thereby to be received/receivable directly into the closure housing in use, the flow control insert has a plurality of dispensing slits that define petals formed in an open position, in which the petals/slits are at least partially closed upon assembly into the dispensing closure.

In some embodiments the insert is a single moulded component.

The insert may, for example, be moulded in PP, PE, TPE or TPS.

The present invention also provides a flow control insert for a dispensing closure, the insert has a plurality of dispensing slits that define petals, in which the petals are formed in an open position, and in which when assembled into the closure the petals are at least partially closed.

The insert may consist of a single piece moulding

The insert may have a central hole pluggable by a closure spigot in use.

The present invention also provides, in combination, a dispensing closure and an insert as described herein.

The present invention also provides a flow control insert which is assemblable into a dispensing closure, the insert comprises a single moulding, the insert has one or more dispensing slits movable between an open position and a closed position, the slit/s are moulded in an open position, in which the slits are moved to the closed position by the action of assembling the insert into the closure and thereafter are movable to the open position by the action of product flow.

In some embodiments radial compression is required during assembly to close petals. Alternatively or additionally vertical/axial compression is required during assembly to close petals.

In some embodiment the closure deforms the insert to close the petals/slits.

The present invention also provides a method of providing a flow control insert, including the steps of: 1—injection moulding an insert with the slits open i.e. not slit after moulding; and 2—using a closure to offer a positive pressure against the open slits to close them upon assembly to the closure.

The present invention also provides a method of providing a dispensing closure with a flow control insert, comprising the steps of: i) injection moulding an insert with a plurality of petals formed in an open position; and ii) providing a dispensing closure; and iii) using the closure to offer a positive pressure against the open petals to close them upon assembly to the closure.

The present invention also provides a closure having an insert as described herein.

The present invention also provides a container in combination with a closure as described herein.

Different aspects and embodiments of the invention may be used separately or together.

Figure 1:
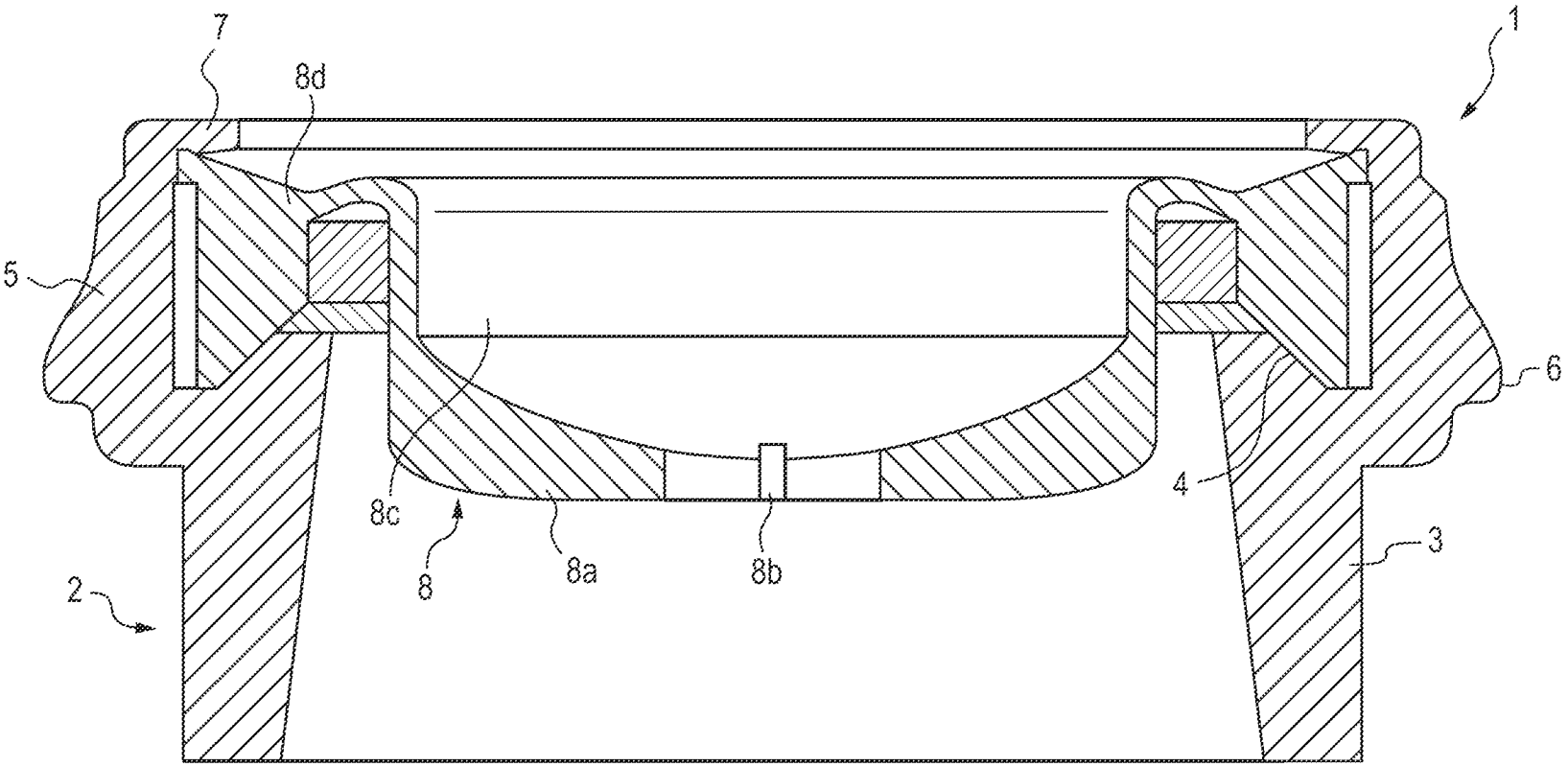
FIG. 1 depicts a self-closing valve sub-assembly in accordance with the present invention.

The present invention is more particularly described and shown in the accompanying drawing.

All orientational terms, such as upper, lower, radially and axially, are used in relation to the drawing and should not be interpreted as limiting on the invention or its connection to a closure.

The example embodiment is described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the invention is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein is not intended to limit the scope. The articles "a," "an," and "the" are singular in that they have a single referent; however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Referring to FIG. 1 a self-closing valve sub-assembly is generally indicated 1. The sub-assembly 1 is described in detail in WO2006/021509.

A retaining ring 2 consists of a moulded single-piece article with a so called "chimney" in the form of a circular wall 3. The chimney 3 provides a surface for assembly machinery to handle the retaining ring 2. At one end of the chimney 3 is a radially outwardly sloping surface 4. At the outer radial end of this sloping surface 4 another circular wall 5, which has the same rotational axis as chimney 3, extends upwards.

Along the circumference of the radially outer surface of wall 5 is a projection in the form of an external sealing bead 6.

At the end of wall 5 is a crimping flange 7 which in its uncrimped condition (not shown) is a relatively short upstanding wall.

A flexible self-closing valve 8 typically has the features shown in FIG. 1. For instance, such a valve 8 has a head portion 8*a* which is thicker towards the edge than the centre and which has at least one slit 8*b* therein. The head portion 8*a* is concave with respect to a container (not shown). This pre-stresses the valve so that it self-closes more easily.

A side-wall portion 8*c* connects the head portion 8*a* with a flange 8*d*. Flange 8*d* is typically shaped such that it has a relatively substantial size in the form of a rim. It is the underside of this flange 8*d* which rests on the sloping surface 4 of the retaining ring 2 when it is located correctly.

To crimp the valve 8 in place, the crimping flange 7 is bent over until is sandwiches the flange 8*d* between itself and the sloping surface 4 as shown in the Figure.

The crimping flange 7 is bent over along the entire circumference of the retaining ring 1 and valve 2.

The sub-assembly 1 allows the valve 8 to be presented in a form which can be easily manipulated and fitted into a dispensing closure. The bead 6 allows the ring 2 to be snap-fitted into a closure with a corresponding bead to hold the ring 2, and consequently the valve, firmly in place.

The form of the inserts shown in FIGS. 2-4 6-9 and 11-16 is generally similar to the ring shown in FIG. 1. In particular the peripheries of the inserts are designed to be standardised with existing retaining rings. This means that valved and valveless inserts can be used interchangeably on the same dispensing closures. Moreover, by standardising at least the engaging parts of the insert it becomes very simple to interchange different types of inserts into the same dispensing closure.

Figure 2:
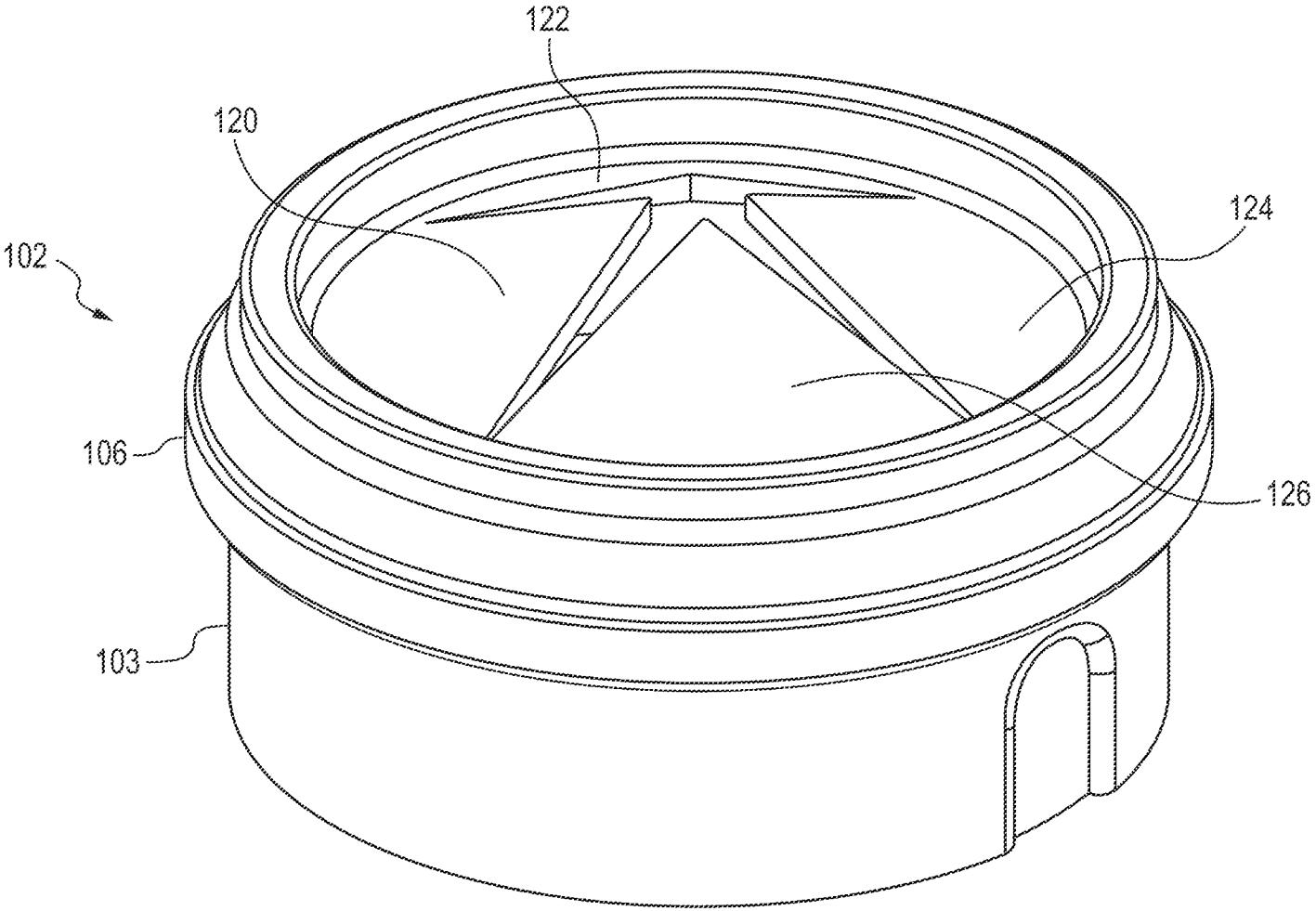
FIG. 2 shows a one-piece molded insert with a sidewall in accordance with the present invention.

FIG. 2, for example, shows a one-piece moulded insert 102 with a sidewall 103. At one end of the sidewall are four generally triangular petals 120, 122, 124, 126. The petals are formed in a raised/open position; there is no post-formation slitting operation required to separate the petals (e.g. with slitting).

Figure 3:
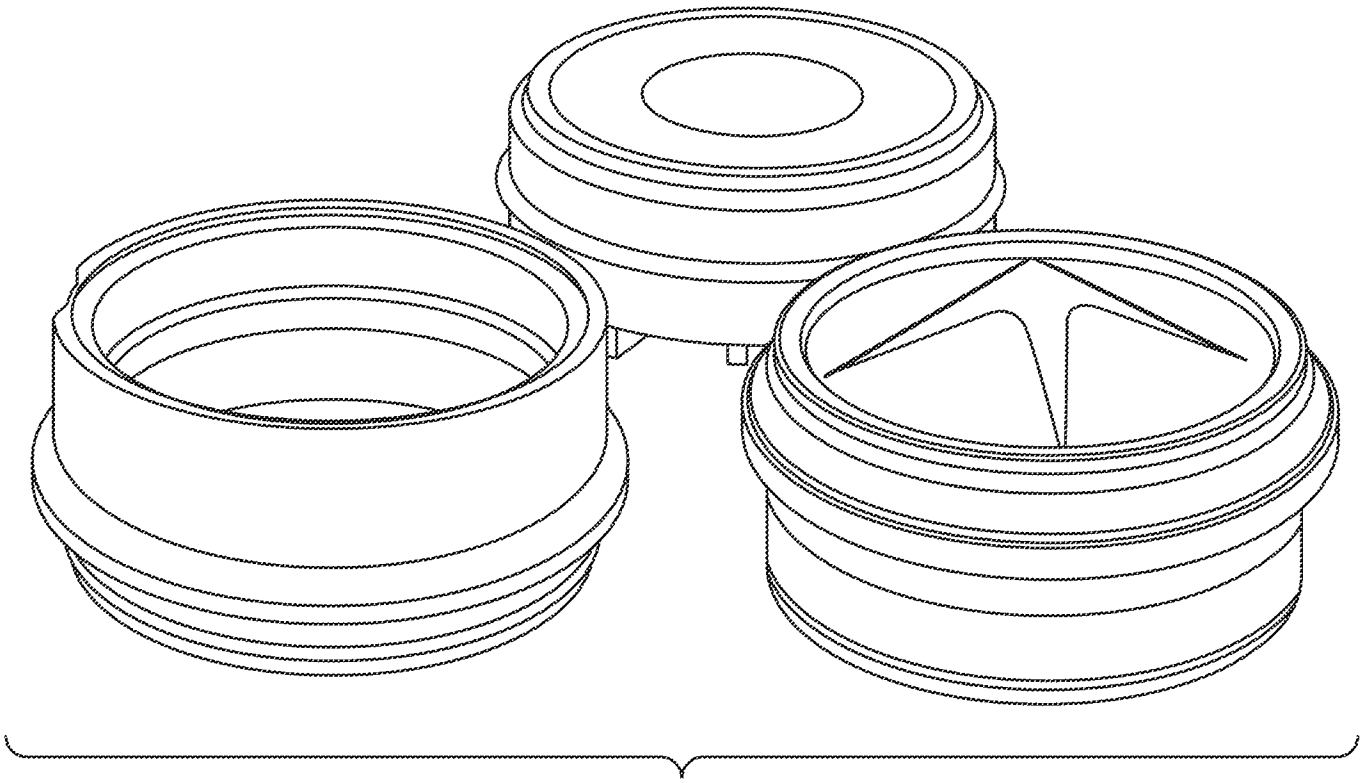
FIGS. 3-4 depict alternative inserts in accordance with aspects of the present invention.
Figure 4:
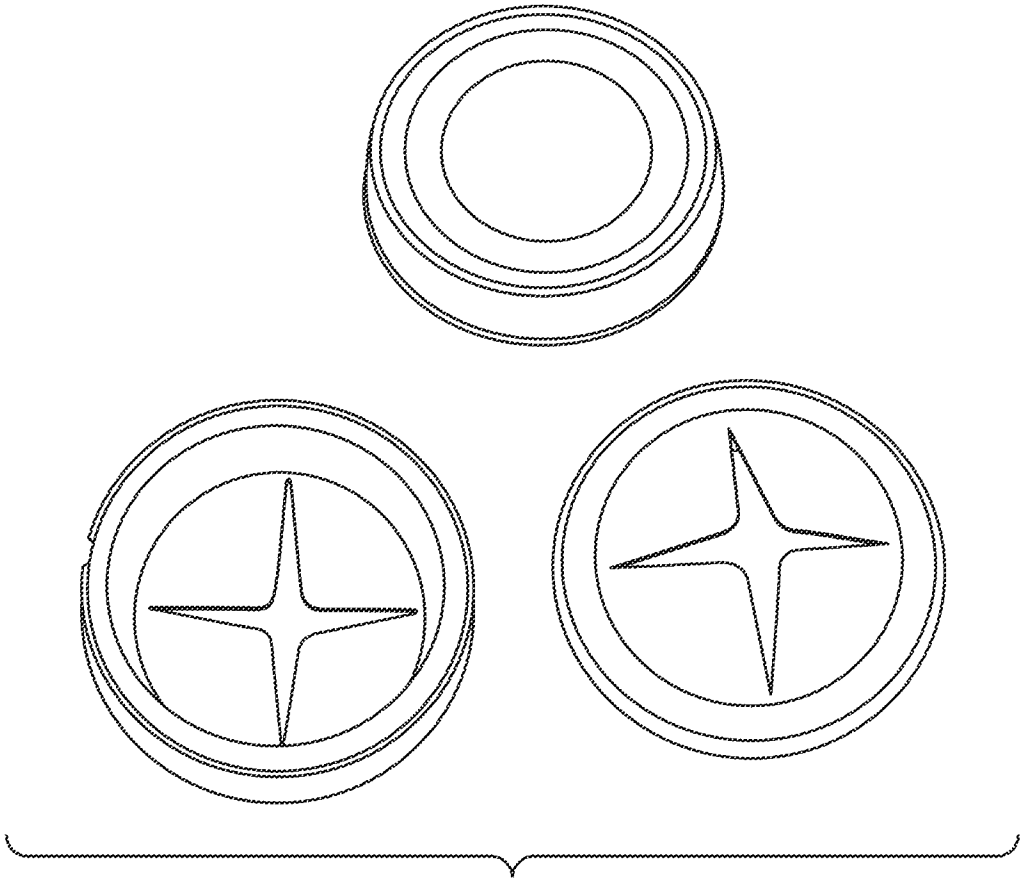

Inserts formed in accordance with this principle are shown in FIGS. 3 and 4.

Figure 5:
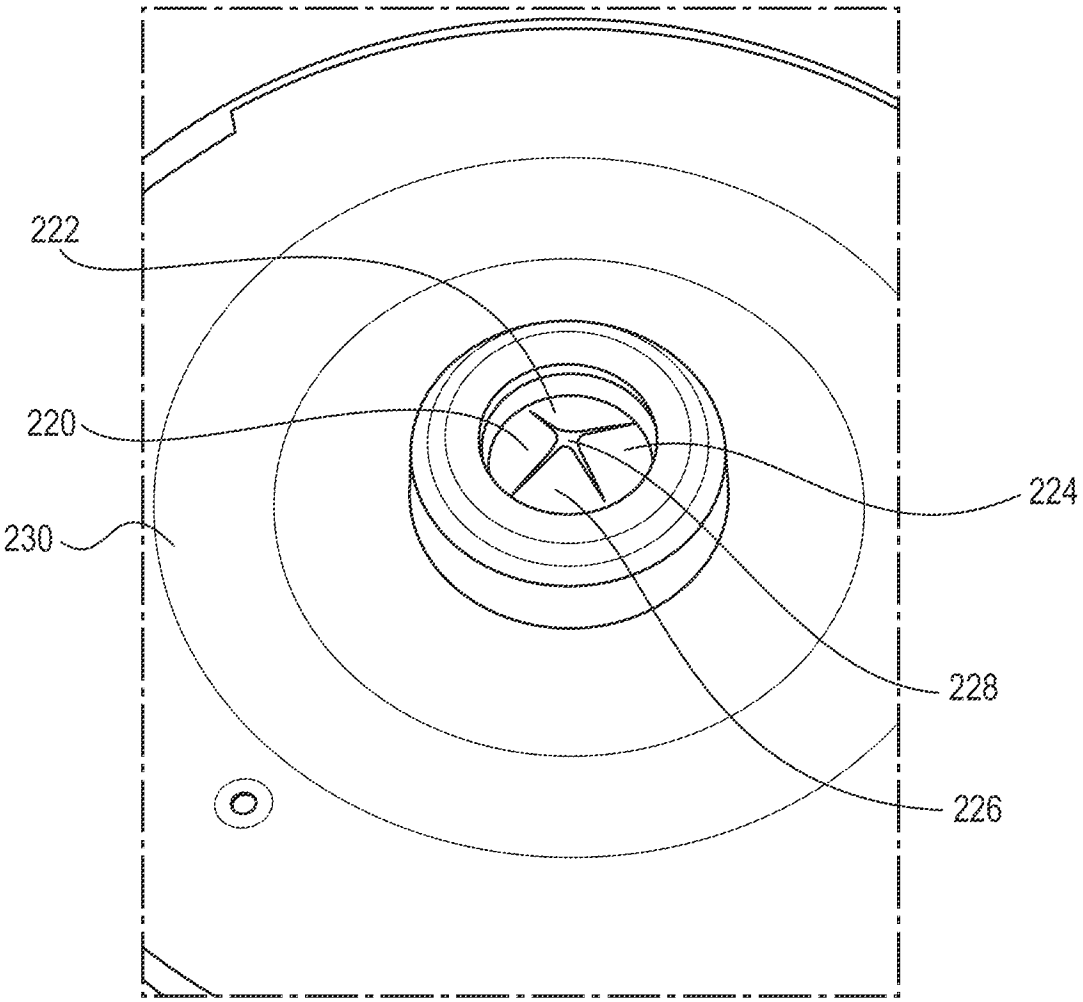
FIG. 5 shows an insert formed in accordance with the present invention and shown fitted into the base of a flip-top dispensing closure.
Figure 6:
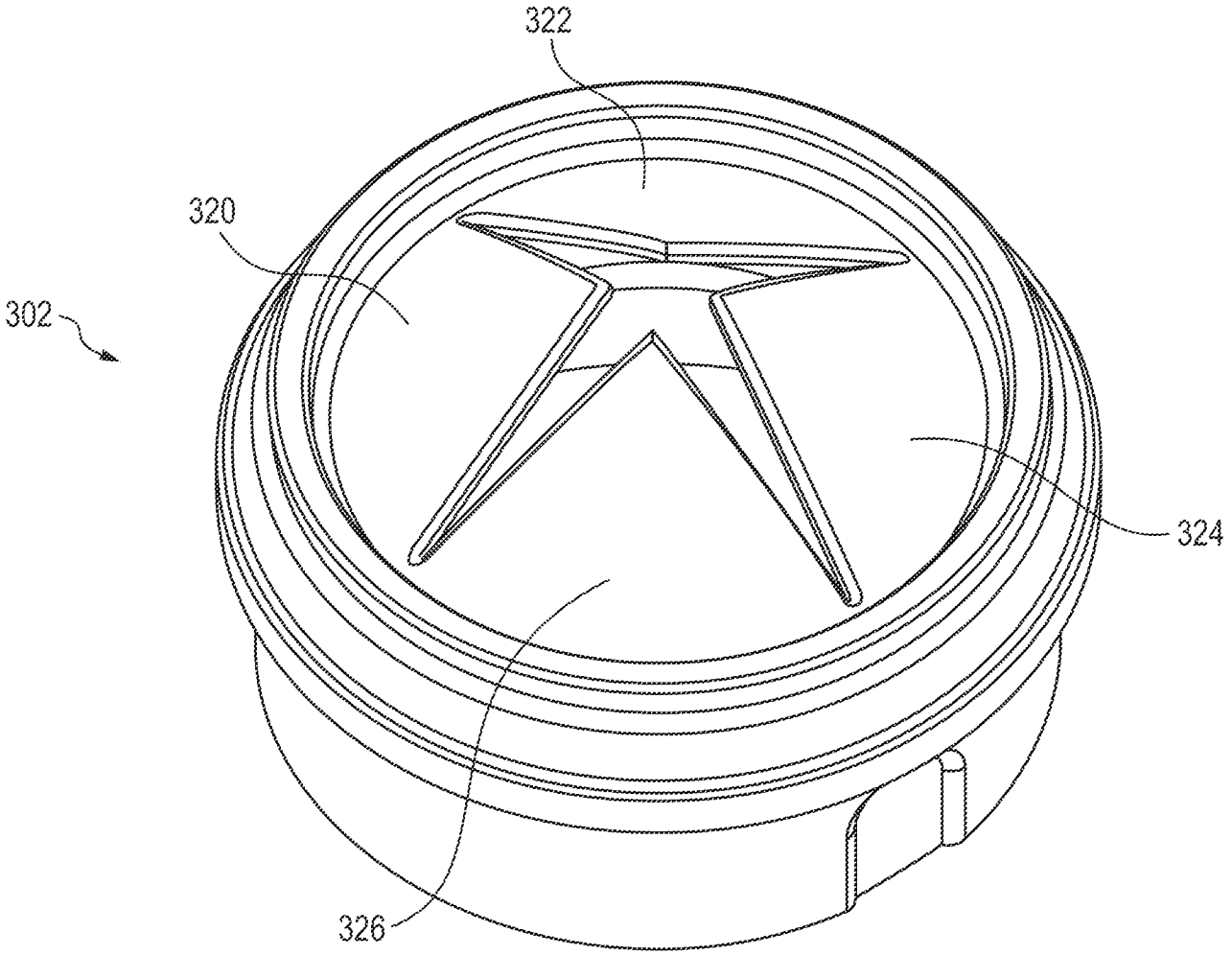
FIGS. 6-9 depict the insert is formed by injection molding.
Figure 7:
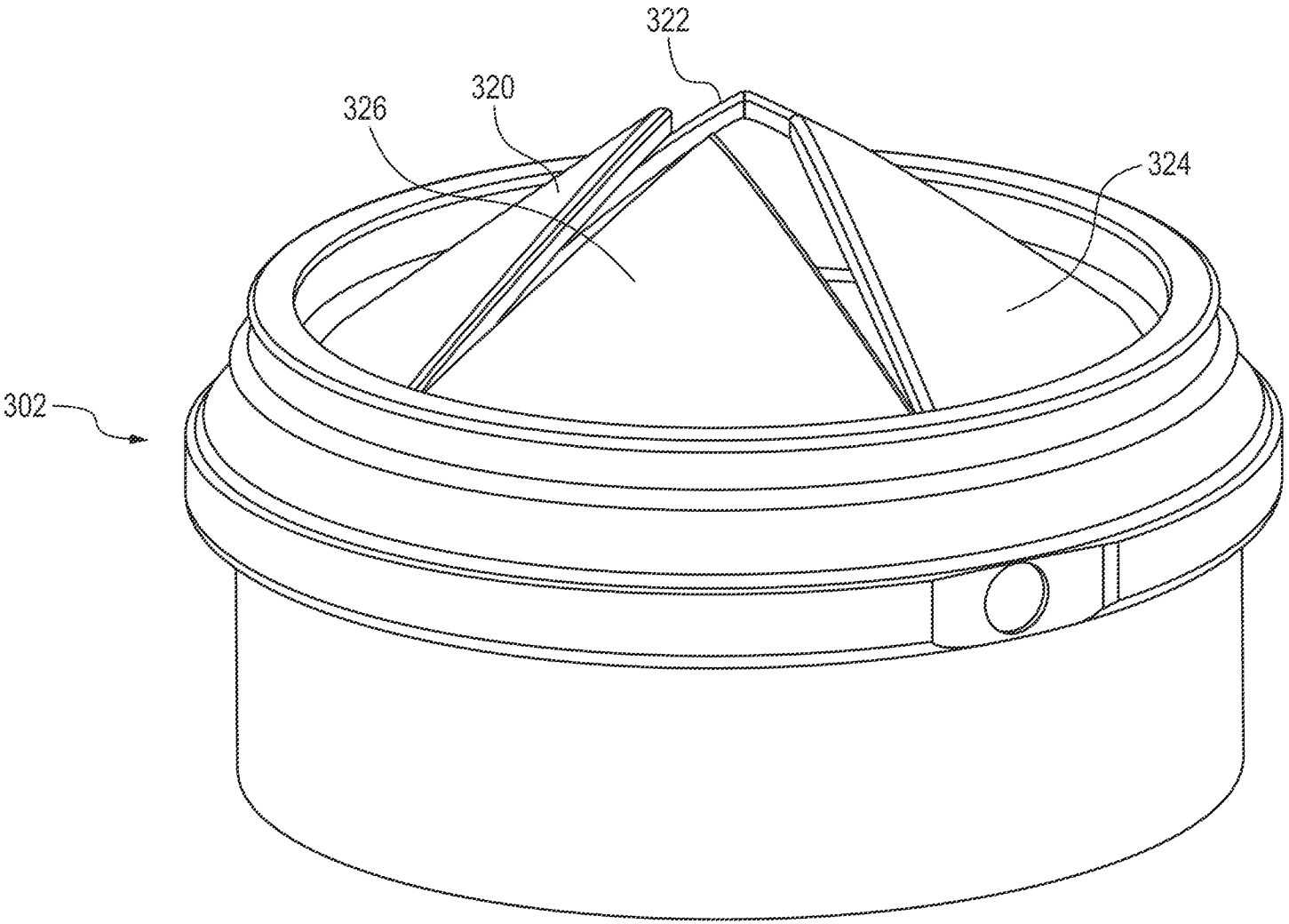
Figure 8:
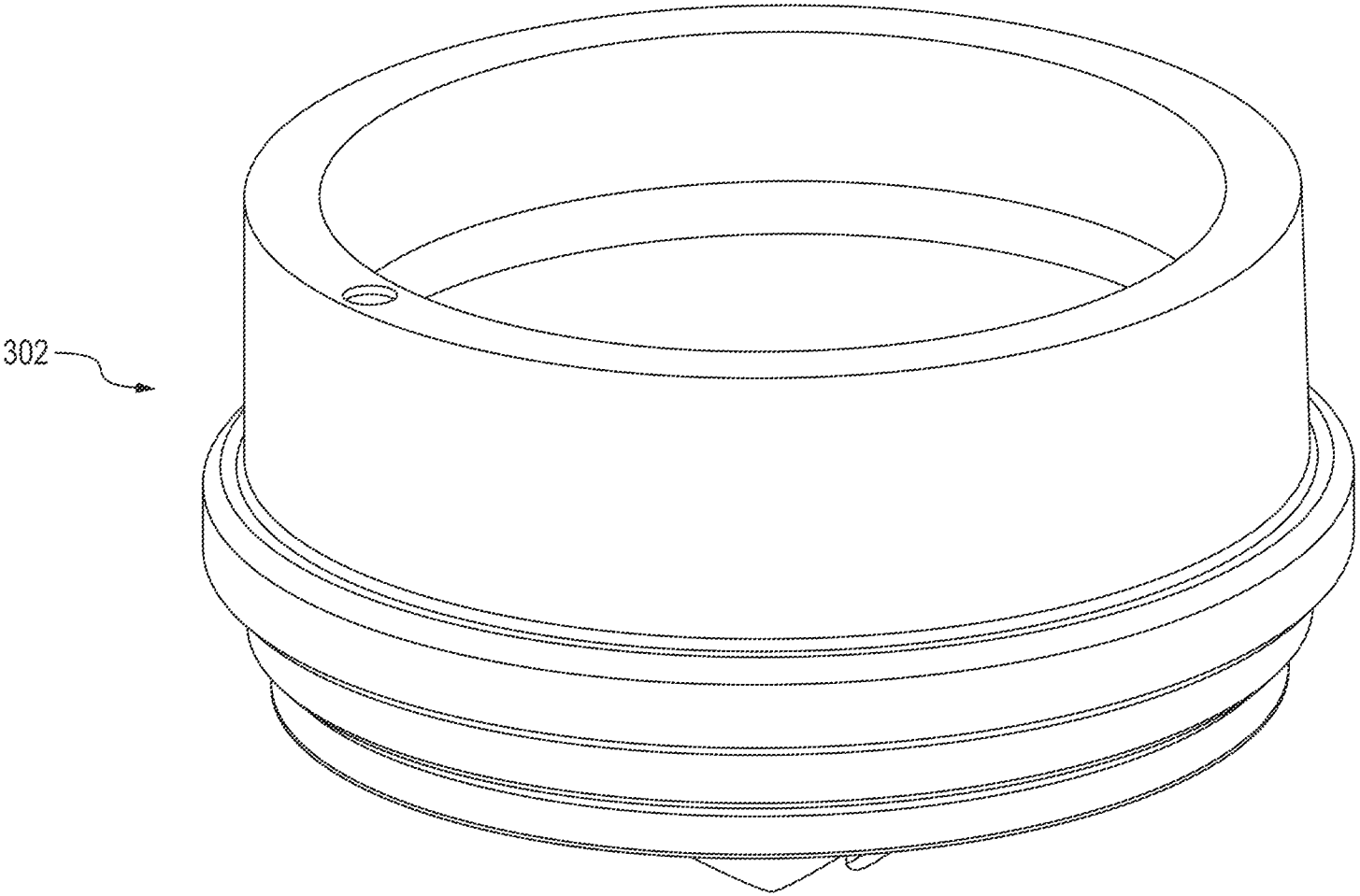

FIG. 5 shows an insert formed in accordance with the present invention and shown fitted into the base 230 of a flip-top dispensing closure. The petals 220, 222, 224, 226 are shown in a closed position; vertical/axial compression is required during assembly to close the slits. The closure deforms the insert to close the slits. The insert has a central hole 228 pluggable by a closure lid spigot (not shown) in use.

Figure 9:
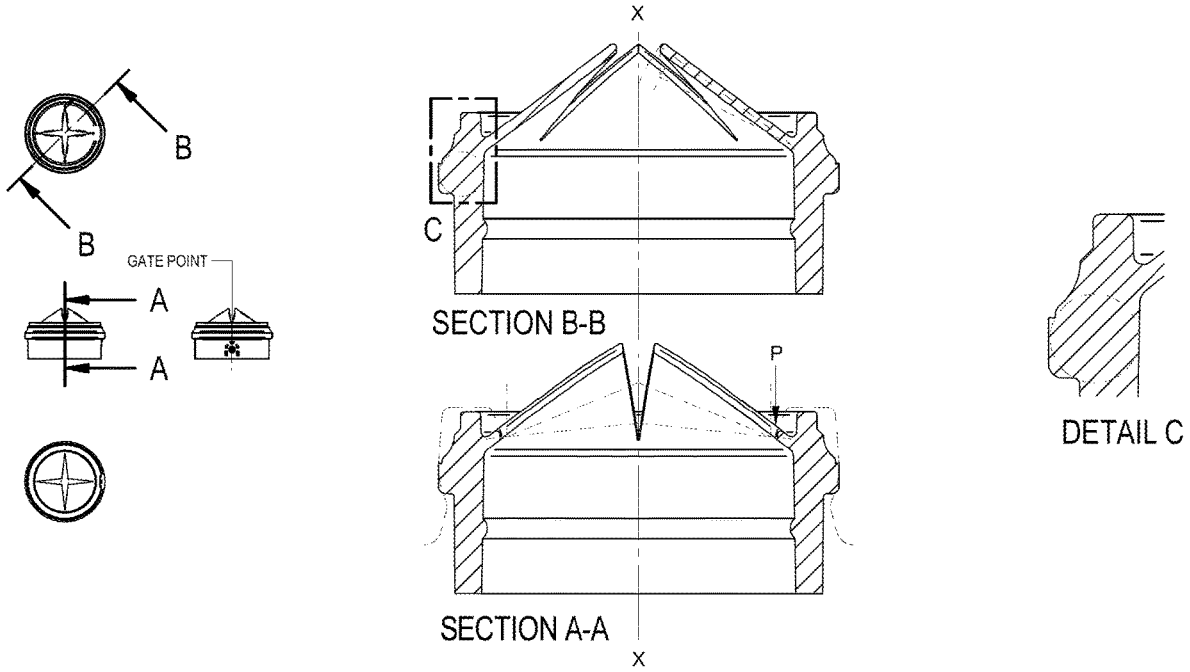

In the embodiment of FIGS. 6 to 9 the insert 302 is formed by injection moulding the design with the petals open i.e. not slit after moulding; then using the closure to offer a positive pressure against the open slits to close them upon assembly to the closure (see dotted lines on section A-A of FIG. 9).

Figure 11:
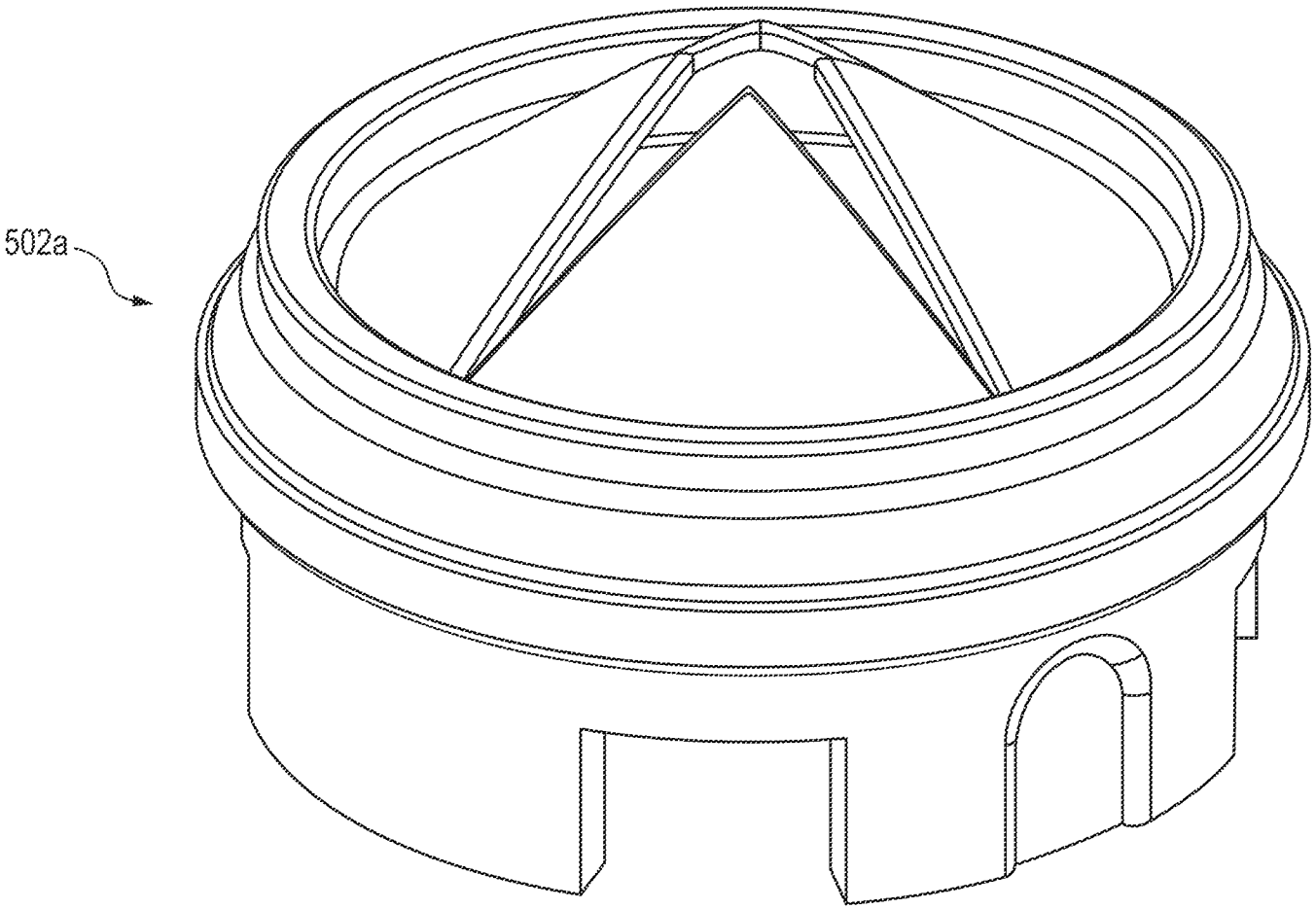
FIGS. 11-13 depict an insert with four petals in accordance with the present invention.
Figure 12:
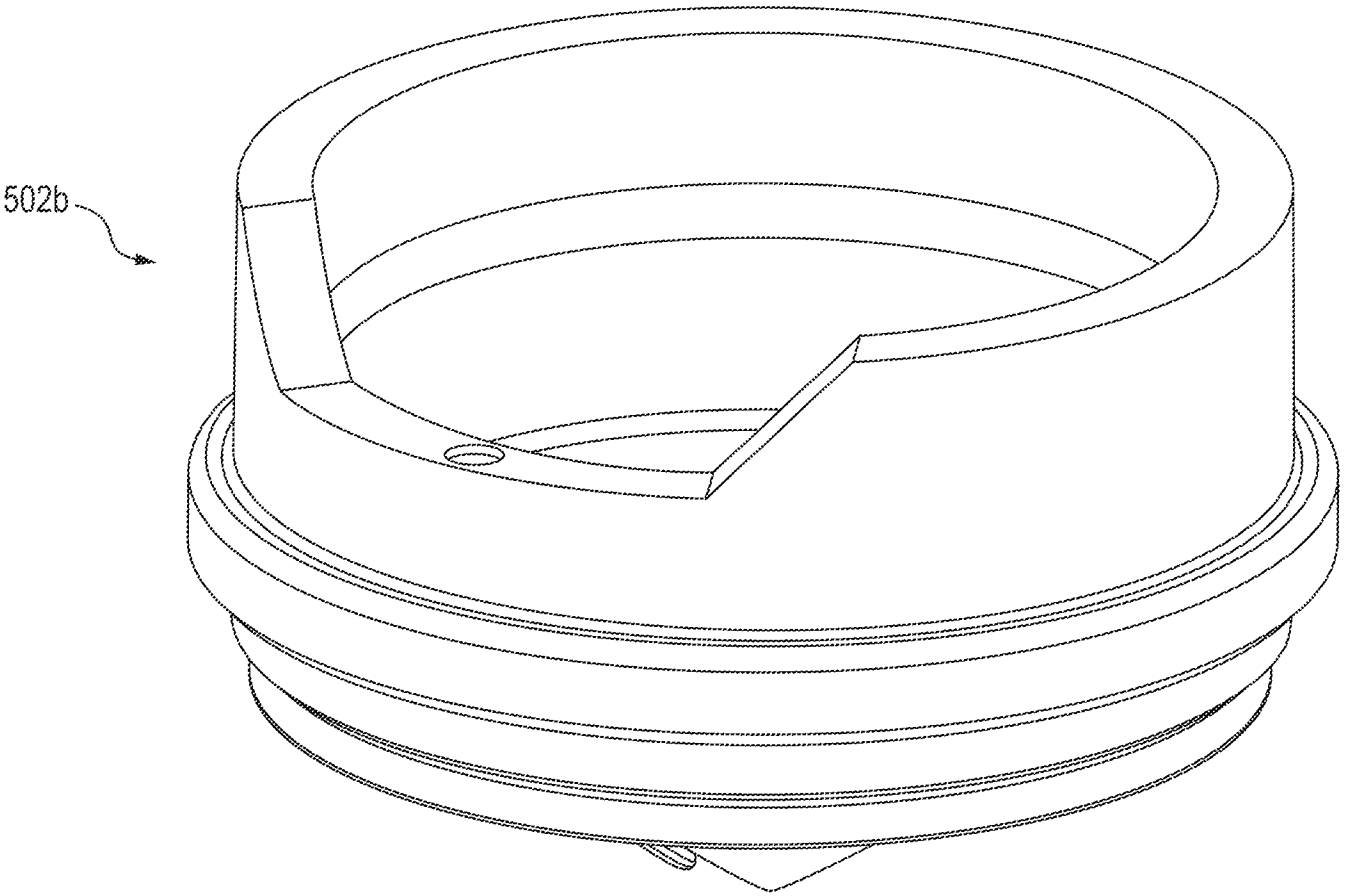
Figure 13:
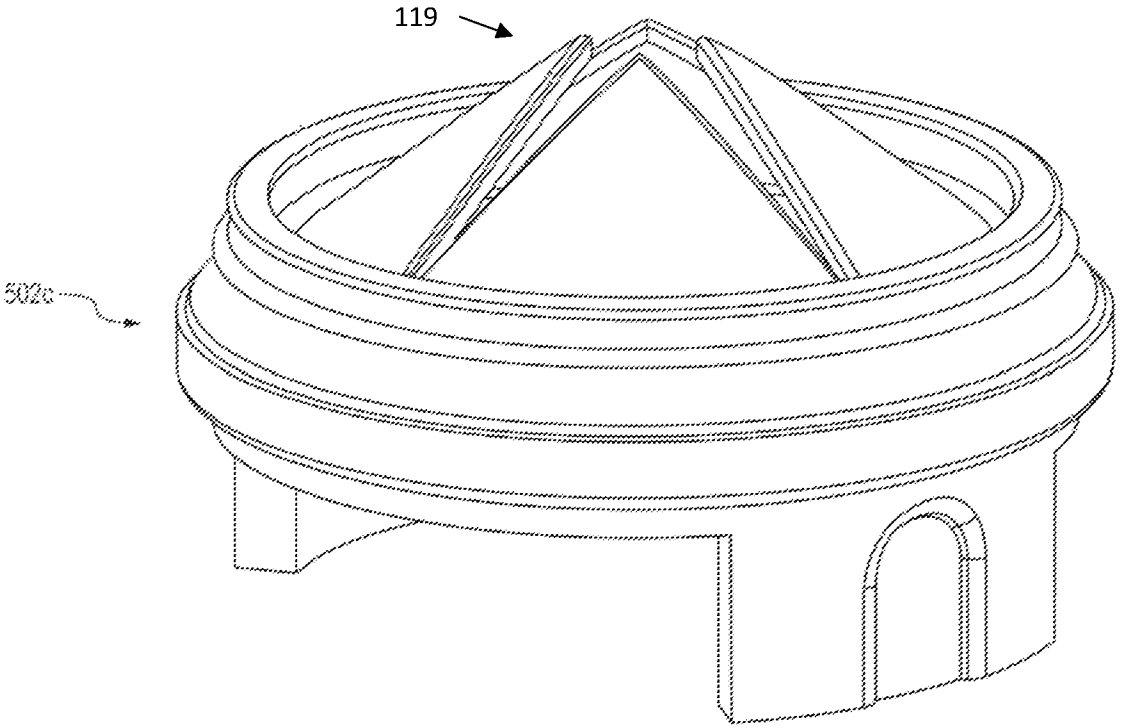
Figure 14:
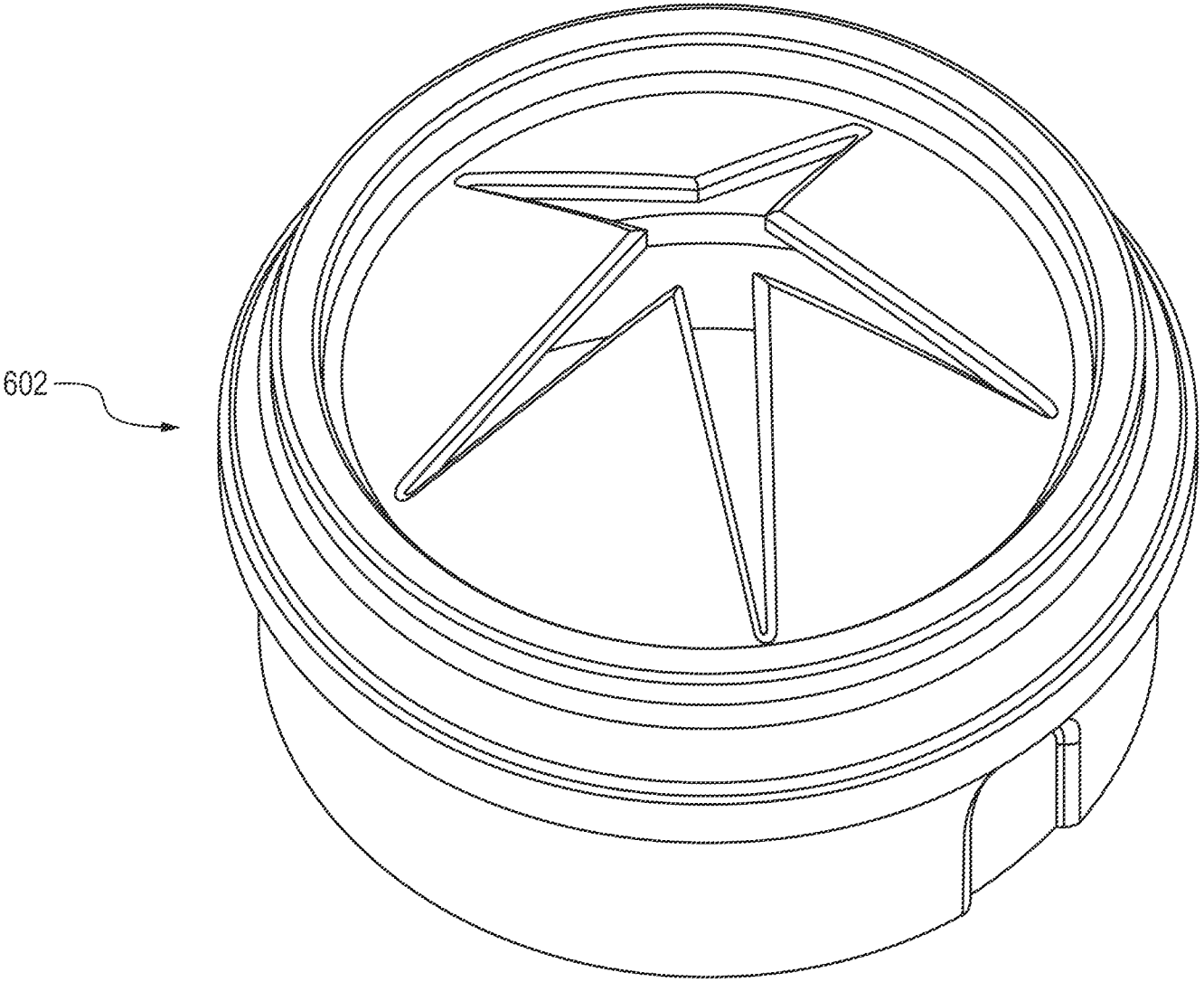
FIG. 14 depicts an insert with five petals in accordance with the present invention.
Figure 15:
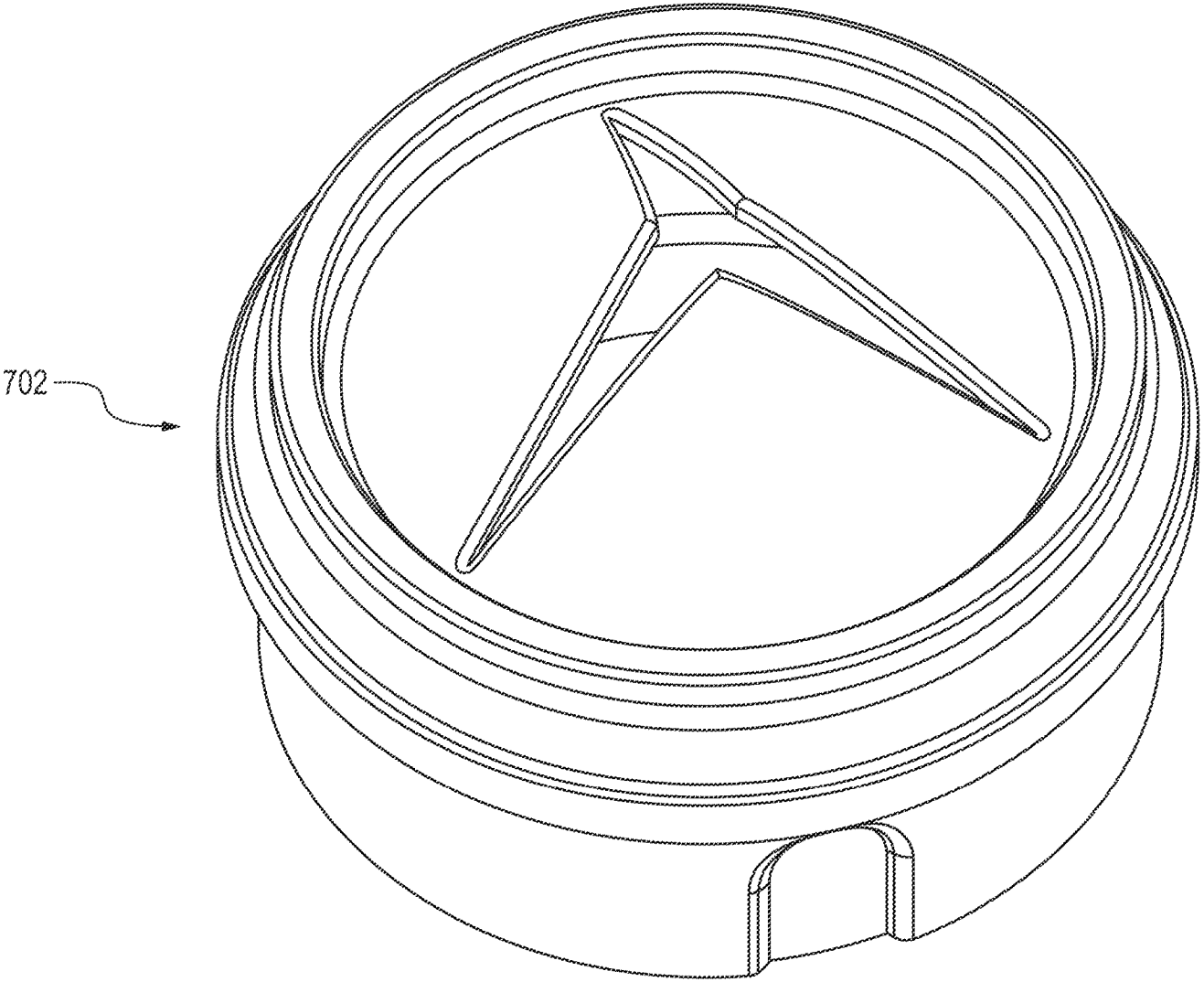
FIG. 15 depicts an insert with three petals in accordance with the present invention.
Figure 16:
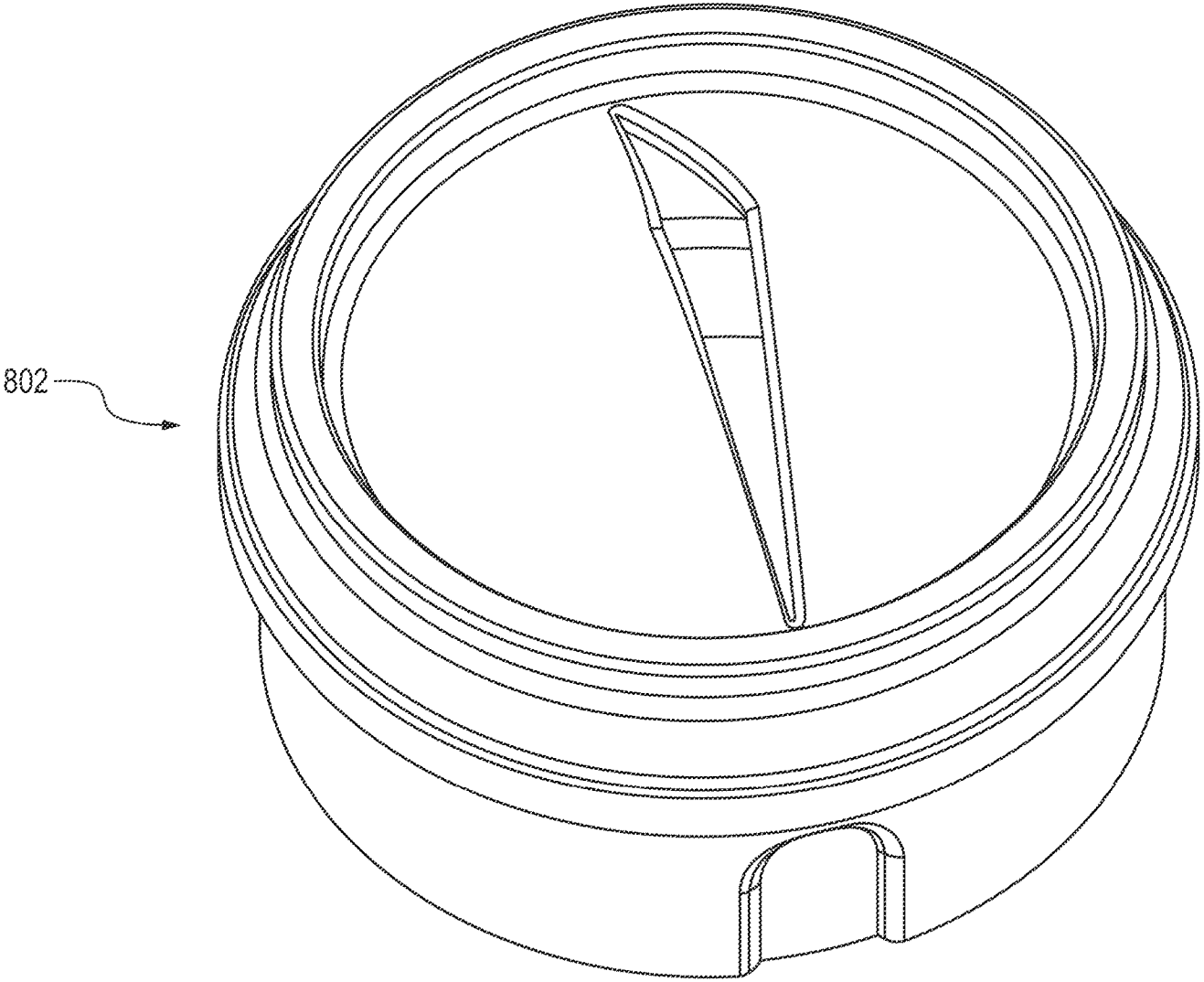
FIG. 16 depicts an insert with two petals in accordance with the present invention.

In the as-moulded condition there are four petals (in other embodiments different numbers of slits and consequential petals are possible: the inserts 502*a*, 502*b*, 502*c* of FIG. 11-13 has four petals; the insert 602 of FIG. 14 has five petals; FIG. 15 has three petals; FIG. 16 has two petals). The geometry of the insert in the as-moulded condition is selected so that when the insert is inserted into the closure, and radially and/or axial inward pressure is applied to the insert head 119 by the closure, the petals close to provide a seal.

Figure 10:
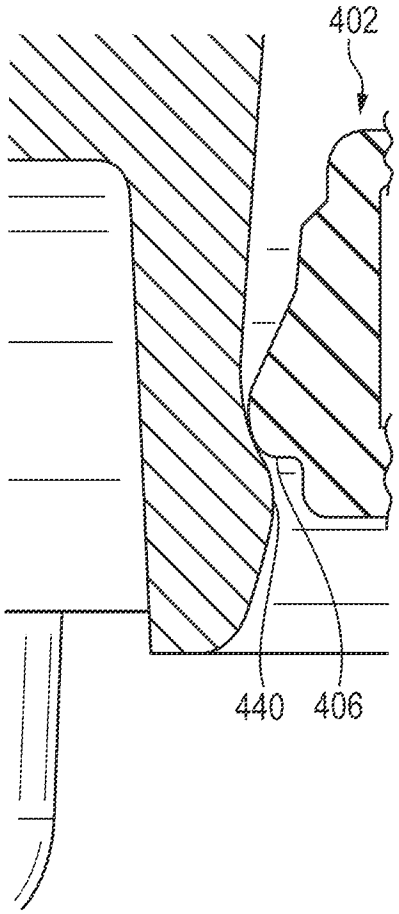
FIG. 10 shows a cross-sectional side view of an insert formed in accordance with the present invention.

FIG. 10 shows a cross-sectional side view of an insert formed in accordance with the present invention, as an alternate to detail C of section B-B of FIG. 9, and shown in place in a dispensing closure, using standardised retention beads 406, 440. In this embodiment a snap-fit seal is achieved between the insert sealing bead 406 and a corresponding projection 440 on the surface of an inner radial wall of the dispensing closure. Further, it is seen that the surface of the inner radial wall of the closure is formed so as to help retain the insert in place. This is achieved by the inner radial wall having a reduced diameter at the lower end such that the insert has to be forced past this reduced diameter before reaching the section of the closure which has a slightly greater diameter. The diameter of the section of the closure, which is slightly reduced in diameter, is less than the maximum diameter of the insert (as measured in the plane of the annular sealing bead).

Once in position the insert may function in the same way as a typical self-closing valve (formed by post-moulding slitting) i.e. when the container is squeezed the product is forced through the slits of the insert which open in response to the increase in pressure within the container.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A flow control insert for a dispensing closure, the flow control insert consists of a single piece molding having an axis, the flow control insert including a head which has a plurality of dispensing slits that define petals, in an as-molded condition the petals are formed in an open position, in which the petals are closed upon assembly of the flow control insert directly into a dispensing closure, wherein geometry of the flow control insert in the as-molded condition is selected so that when the flow control insert is directly inserted into the dispensing closure, pressure is applied to the head, along the axis and against the petals, by the dispensing closure, and the petals close to provide a seal.

2. A flow control insert according to claim 1, wherein the flow control insert is molded in PP, PE, TPE or TPS.

3. A flow control insert according to claim 1, further including a sidewall.

4. A flow control insert according to claim 1, wherein the flow control insert has a central hole.

5. A flow control insert according to claim 1, wherein in the as-molded condition the flow control insert has two, three, four or five petals.

6. A flow control insert in combination with a dispensing closure having a housing adapted to receive the flow control insert, the flow control insert consists of a single piece molding having an axis, the flow control insert having an insert engagement means adapted to engage the housing and thereby to be received directly into the dispensing closure housing in use, the flow control insert has a head having a plurality of dispensing slits that define petals, in an as-molded condition the petals are formed in an open position, in which the petals are at least partially closed upon assembly into the dispensing closure by pressure applied to the head, along the axis and against the petals, by the dispensing closure.

7. A combination according to claim 6, wherein the insert engagement means includes a bead projecting radially outward from an exterior wall for snap-fitting the flow control insert into the dispensing closure.

8. A combination according to claim 6, wherein a snap-fit seal is achieved between an insert sealing bead and a corresponding projection on a surface of an inner radial wall of the dispensing closure.

9. A combination according to claim 6, wherein a surface of an inner radial wall of the dispensing closure is formed so as to help retain the flow control insert in place.

10. A combination according to claim 6, wherein an inner radial wall of the dispensing closure has a reduced diameter at a lower end such that the flow control insert has to be forced past this reduced diameter before reaching a section of the dispensing closure which has a slightly greater diameter, and wherein the diameter of the section of the dispensing closure, which is slightly reduced in diameter, is less than the maximum diameter of the flow control insert as measured in a plane defined by an annular sealing bead.

11. A combination according to claim 6, wherein the flow control insert is molded in PP, PE, TPE or TPS.

12. A combination according to claim 6, wherein the flow control insert further includes a sidewall.

13. A combination according to claim 6, wherein the flow control insert has a central hole.

14. A combination according to claim 6, wherein the flow control insert in the as-molded condition, has two, three, four or five petals.

* * * * *